US011165134B1

(12) United States Patent
Kingman

(10) Patent No.: US 11,165,134 B1
(45) Date of Patent: Nov. 2, 2021

(54) BIASED ANTENNA MOUNT FOR MOUNTING AN ANTENNA ON A SUPPORT MEMBER

(71) Applicant: Connor Kingman, Lemoore, CA (US)

(72) Inventor: Connor Kingman, Lemoore, CA (US)

(73) Assignee: Kingman Ag, LLC, Lemoore, CA (US)

( * ) Notice: Subject to any disclaimer, the term of this patent is extended or adjusted under 35 U.S.C. 154(b) by 51 days.

(21) Appl. No.: 16/848,788

(22) Filed: Apr. 14, 2020

(51) Int. Cl.
*H01Q 1/12* (2006.01)
*H01Q 1/32* (2006.01)
*H01Q 1/20* (2006.01)

(52) U.S. Cl.
CPC ..... *H01Q 1/1235* (2013.01); *H01Q 1/20* (2013.01); *H01Q 1/3275* (2013.01)

(58) Field of Classification Search
CPC ..... H01Q 1/125; H01Q 1/1264; H01Q 1/12; H01Q 1/1207; H01Q 1/1235; H01Q 1/1242; H01Q 1/27; H01Q 1/3216; H01Q 1/3275; H01Q 1/32; H01Q 3/02; H01Q 1/20; H01Q 1/08
See application file for complete search history.

(56) References Cited

U.S. PATENT DOCUMENTS 2,270,514 A * 1/1942 Doane ..... H01Q 1/084 52/110
2,875,330 A * 2/1959 Padgett ..... H03G 3/24 455/269
2,962,248 A * 11/1960 Edwin ..... H01Q 1/3275 248/514
6,236,377 B1 * 5/2001 Hussaini ..... H01Q 1/1207 343/715
6,456,258 B1 * 9/2002 Bragg ..... H01Q 1/088 343/757
7,015,872 B1 * 3/2006 Little ..... H01Q 1/1228 343/874
7,436,367 B2 * 10/2008 Blickle ..... H01Q 1/1214 343/711

* cited by examiner

*Primary Examiner* — Tho G Phan
(74) *Attorney, Agent, or Firm* — Richard A. Ryan

(57) ABSTRACT

An antenna mount for supporting an antenna on a support member in a manner which reduces the likelihood of the antenna, antenna mount and support member being damaged by an object making contact with the antenna. The antenna mount has a mounting plate connected to the antenna, a pivot mechanism connecting the mounting plate to the support member and a biasing mechanism interconnecting the pivot mechanism and an anchor associated with the support member. The pivot mechanism allows the antenna to move to a pivoted position in response to contact with an object. The biasing mechanism is configured to hold the antenna in a desired operating position during use and to move the antenna from its pivoted position back to the desired operating position after contact with an object. The antenna mount can be utilized with an upwardly extending tubular support member of a vehicle.

20 Claims, 7 Drawing Sheets

BIASED ANTENNA MOUNT FOR MOUNTING AN ANTENNA ON A SUPPORT MEMBER

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to apparatuses that are utilized to mount an antenna on a support member. Specifically, the present invention relates to such mounting apparatuses that structured and arranged to pivotally mount an antenna on a support member in a manner which allows the antenna to controllably pivot rearward in response to contact against the antenna and then reposition the antenna in its normal operating position. More specifically, the present invention relates to such apparatuses that are particularly useful for pivotally mounting an inflexible antenna on a tubular member associated with a motor vehicle.

B. Background

Antennas are utilized throughout the world to electronically connect devices together to facilitate communication between the devices. Many of these antennas are associated with motor vehicles and other mobile vehicles to allow various types of communication in a variety of manners, including between persons who are in separate vehicles, between a person not in a vehicle and a person in a vehicle, between a person and the vehicle itself, between a computer or other electronic device and a person in a vehicle and/or between a computer or other electronic device and the vehicle itself. Other types of electronic communication with or between a persons and/or vehicles also require an antenna to facilitate effective communication. The communication may be voice, computer instructions or other electronic signals and may be accomplished via cellular, radio, satellite, wifi, Bluetooth® and other electronic networks. A vehicle with which electronic communication is utilized and, therefore, require an antenna to be associated therewith to communicatively connect, may be a motor vehicle or a non-motorized vehicle. A motor vehicle could be a car, truck, RV, motorcycle, tractor, harvester and the like, including those vehicles that are remotely-controlled or autonomously operated. A non-motorized vehicle may be trailer, equipment and the like which are, typically, pulled behind a motor vehicle, including those set forth above.

Antennas which are mounted to a vehicle, whether motorized or not, are likely to encounter an obstacle that will be contacted by the antenna as the vehicle moves under or otherwise near the obstacle, which contact could result in damage to the obstacle, antenna and/or vehicle. To prevent, or at least minimize, the possibility of such damage, most antennas are either designed to flex away from the obstacle or are mounted to the vehicle in a manner which allows the antenna to respond to the contact in a manner in a manner to reduce or prevent such damage. One common configuration for an antenna is the "whip" type of antenna that comprises a thin, elongated, flexible wire-like member which flexes upon contact with an obstacle. Often these whip antennas also have an externally mounted spring at or near where the antenna is mounted to the vehicle which is configured to allow the antenna to more easily flex away from the obstacle and then move back into its normal operating position, which typically disposes the antenna in a vertical or near-vertical orientation. The spring of these antennas is configured to absorb energy from the impact force that results from the contact with the obstacle and allow the flexing that, typically, prevents damage to the antenna, obstacle and vehicle. The antenna mount for this type of antenna is structured and arranged to mount the spring, and therefore the antenna to which it is attached, to a surface of the vehicle.

The whip antennas are generally configured to receive a particular frequency range and a provided with a length that is capable of resonating within that range. Other types of antennas are configured in a much more complex manner to be able to receive multiple frequency bands (i.e., wide-band) and/or particular types of signals, such as cellular and wifi or the like. Typically, these types of antennas are utilized with fixed structures and, therefore, are mounted to the structure in a manner that does not need take into account movement of the antenna and possible contact with an obstacle as a result of that movement. A common mounting system for these types of antennas comprises an L-shaped bracket with the antenna fixedly mounted on the horizontal portion of the bracket and the vertical portion of the bracket fixedly attached to the structure. Relatively recently, these types of antennas have been found to be beneficial for use with remotely-controlled and autonomous motor vehicles, particularly those which are utilized in the agricultural industry to perform a variety of agricultural-related tasks in a field, orchard, vineyard or other growing area. Such agricultural tasks may include, but are not limited to, preparing the land, planting crops, maintaining and treating the field and plants while the plants are growing and/or crops are growing on the plants, harvesting the crops from the field or plants and clearing the field after harvesting.

As generally known to persons skilled in the relevant art, the operation and movement of a remote-controlled motor vehicle is fully controlled by a person who is located remotely, sometimes very remotely, from the vehicle. In contrast, autonomous vehicles are configured to operate and move on their own, without any direct control by a person in the vehicle or outside of the vehicle. In a common configuration, both types of motor vehicles have equipment and systems, such as cameras, computers and the like, that are utilized to analyze the area around the vehicle and control operating components of the vehicle to start, stop and move the vehicle. With regard to remote-controlled motor vehicles, the equipment and systems thereof allow the remotely located person to see and analyze the vehicle surroundings to make decisions regarding the operation and movement of the vehicle. With regard to autonomous motor vehicles, the equipment and systems thereof allow the computer system of the motor vehicle to visualize and analyze the vehicle surroundings to make decisions regarding the operation and movement of the vehicle based on the data the equipment and systems receive and process. In general, an autonomous vehicle uses on-board computers to process data from the vehicle (i.e., speed, direction and the like), one or more object data gathering devices (camera, radar, LIDAR or the like) configured to be able to sufficiently visualize objects in the vehicle's path and other associated equipment to determine whether it is safe or not for the vehicle to move or continue moving in a particular direction. Although the autonomous vehicle is configured to operate in an area substantially on its own, it is still necessary for such vehicles to be able to communicate with an operation center to allow an operator to, at least, monitor the operation of the vehicle as it autonomously accomplishes its objectives. As such, both remotely-controlled and autonomous motor vehicles require a complex antenna system that cannot be provided by a relatively simple whip antenna.

The antenna utilized with remotely-controlled or autonomous motor vehicles are typically mounted on a support member at or near an upper end of the motor vehicle so that the antenna will be positioned to best be able to receive and transmit signals while the vehicle is moving through an area, particularly an agricultural area, in light of potential objects which could interfere with such signals. A reality of utilizing a remotely-controlled or autonomous motor vehicle in an agricultural area is that the antenna is likely to make contact with items as it moves through the area. Such items may be branches of trees or vines, components of plant trellises or other plant support members, signs, wires utilized for support or other purposes and the like. As will be readily appreciated by those skilled in the art, preferably the antenna system will be configured to reduce the likelihood the antenna and/or the vehicle to which the antenna is attached will not be damaged by such contact. One manner in which to reduce the likelihood of damage to an antenna and/or the vehicle to which it is attached is to configure the antenna mount that mounts the antenna to the vehicle to allow the antenna to pivot due to the contact and then safely move back to the antenna's normal operating position to facilitate communication between the vehicle and an operating center or other location. Any such antenna mount needs to also allow the antenna to electronically connect to the components of the vehicle which receive, process and send electronic signals that allow remote operation of the vehicle (primarily for remotely-controlled vehicles) and/or monitoring of the vehicle.

The prior art discloses a wide variety of different types of antenna mounts, in addition to the whip antenna mounts described above, that are generally configured to allow an antenna to move, typically by pivoting rearward, in response to contact with an object. For instance, U.S. Pat. No. 6,331,838 to Scott, et al., describes a flexible vehicle antenna that is adapted to be mounted to a motor vehicle. The antenna includes a base configured to be secured to the vehicle, an elongated mast, a spring member which flexibly connects the mast to the base and an elastomeric cover that envelopes the spring between the mast and base to allow the mast to deflect in the event of contact with an object. U.S. Pat. No. 5,221,929 to Ott describes a hinged magnetic antenna mount having a magnetic base that mounts to a surface of a vehicle, an antenna support platform and a hinge that connects the platform to the base, with the platform at least partially made out of a ferromagnetic material chosen so the bond between the base and the vehicle is stronger than the bond between the platform and the base. U.S. Pat. No. 9,490,524 to Miller et al. describes a spring boot for a mobile antenna comprising a cylindrical main body, an annular flange at the lower end of the body and an annular rim at the upper end of the body to enclose the spring portion of a whip-type antenna. The spring boot is hollow and shaped to match the shape of the antenna spring to provide added dampening to the antenna when it makes contact with an object. U.S. Patent Publication No. 2003/0112191 to Maeda, et al. describes a vehicle roof mount antenna comprising an antenna rod, an antenna base that attaches to the rod, a joint assembly that is attached to the rod, a pair of pivotal support portions that connect the joint assembly to the base in a manner which allows the swivel and a torsion spring associated with the joint assembly to return the joint assembly to a predetermined swiveling position in the event an external force hits the rod. A variety of other prior art antenna mounts are utilized to secure an antenna, most of which are of the whip-type, to a vehicle.

Despite the foregoing and other related prior art, there exists a need for an improved antenna mount that can securely mount an antenna to a surface and which is configured to allow the antenna to controllably move in response to contact with an object. More specifically, what is needed is an improved antenna mount that can be attached to a surface and which allows the antenna to move in response to contact with an object and is able to direct the antenna back to its originally selected mounting position, which is typically an upright or at least generally upwardly disposed position, without damage to the antenna, antenna mount and the surface. The new antenna mount should be particularly adapted for use with inflexible, non-whip type of antennas, such as the multi-band omni-directional antennas commonly utilized for cellular, satellite, wifi and like communications, that are not capable of inherently flexing in response to contact with an object in order to reduce the likelihood of damage to the antenna, antenna mount and the surface to which the antenna is mounted when a force is applied to the antenna, such as when the antenna contacts an object due to movement of the surface to which the antenna is attached. Preferably, the new antenna mount should be structured and arranged to be securely attached to a component of a moveable vehicle, whether the vehicle moves on its own power or is pulled or pushed to achieve movement, to mount an antenna for use with the vehicle, particularly remotely-controlled and autonomous vehicles that need to be able to communicate with other vehicles and/or a command center. In one use, the new antenna mount should be particularly structured and arranged to be cooperatively mounted on a tubular member of a vehicle. Preferably, the new antenna mount should be adaptable to a wide range of different types of antennas and surfaces, easy to install and use and relatively inexpensive to manufacture.

SUMMARY OF THE INVENTION

The following presents a simplified summary of the disclosure of the present invention in order to provide a basic understanding of the invention to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later.

The use of terms such as "including", "comprising" or "having" and variations thereof herein is meant to encompass the items listed thereafter and equivalents thereof. The terms "a" and "an" herein do not denote a limitation of quantity, but rather denote the presence of at least one of the referenced item. Further, the use of terms "first", "second", and "third", and the like, herein do not denote any order, quantity, or importance, but rather are used to distinguish one element or feature of an element from another. The term "and/or," when used herein with a list of two or more items, means that any one of the listed items can be employed by itself, or any combination of two or more of the listed items can be employed.

The biased antenna mount of the present invention provides the benefits and solves the problems which are identified above. That is to say, the present invention discloses a new and improved antenna mount for mounting an antenna to a support surface in a manner which allows the antenna to controllably move in response to contact with an object in order to prevent, or at least minimize, damage to the antenna, antenna mount and support surface. More specifically, the antenna mount of the present invention is configured to be attached to a support surface, to pivot in response to a force being applied to the antenna, such as when the antenna contacts an object, and to then direct the antenna back to its originally selected mounting position, which is typically an upright or at least generally upwardly disposed position, without damage to the antenna, antenna mount and the support surface. The new antenna mount is particularly adapted for use with inflexible, non-whip type of antennas, such as multi-band, omni-directional antennas that are commonly utilized for cellular, satellite and wifi communications, which antennas are not normally capable of inherently flexing in response to contact with an object, in order to reduce the likelihood of damage to the antenna, antenna mount and the support surface to which the antenna is mounted when a force is applied to the antenna, such as when the antenna contacts an object due to movement of the support surface to which the antenna is attached. In one use, the new antenna mount is beneficially structured and arranged to be securely attached to a component of a moveable vehicle, whether the vehicle moves on its own power or is pulled or pushed to achieve movement. In one particular use, the new antenna mount of the present invention is configured to mount an inflexible, multi-band, omni-directional antenna to a component of a remotely-controlled or autonomous vehicle, which vehicles need to be able to communicate with other vehicles and/or a command center using such antennas. The new antenna mount is structured and arranged to be cooperatively mounted on a tubular member of a vehicle, including motor vehicles such as remotely-controlled and autonomous vehicles. In the preferred embodiments, the new antenna mount is adaptable for use with a wide range of different types of antennas and support surfaces, easy to install and use and relatively inexpensive to manufacture.

One embodiment of utilizing the new antenna mount is to mount a multi-band, omni-directional antenna on a support member of a remotely-controlled or autonomous motor vehicle in the agricultural industry to assist growers and others with preparation, maintenance, harvesting and removal operations. For purposes of describing the configuration and use of the present invention with regard to use of the antenna mount to mount an antenna on a motor vehicle in the agricultural industry, the term "plant" is utilized herein to collectively refer to any type of row crop, vine, tree, bush or the like, the term "crop" is utilized herein to collectively refer to any beneficial product that is produced by a plant and the term "agricultural area" is utilized herein to collectively refer to a field, vineyard, orchard or any other area that is utilized to grow plants to produce crops. While describing the present invention or the related prior art, reference may be made to certain specific types of plants, crops and/or growing areas in order to describe the attributes of the new apparatus and system for use in agricultural areas and/or to better explain the prior art. Persons skilled in the art, however, will realize these same attributes are also relevant to other types of plants, crops or growing areas.

In one embodiment of the present invention, the new antenna mount for mounting an antenna to a support member generally comprises a pivoting mechanism interconnecting the antenna and the support member and a biasing mechanism interconnecting the support member and the pivoting mechanism. The pivoting mechanism has a pivot section that is attached to or integral with the antenna and a stationary section which is attached to or integral with the support member. The pivoting mechanism is structured and arranged to support the antenna in a desired operating position, such as a vertical orientation, and allow the antenna to move to a pivoted position, such as a horizontal orientation, in response to an external force applied to the antenna. The biasing mechanism has a biasing member with a first end that is attached to or integral with the support member and a second end which is attached to or integral with the pivot section so as to interconnect the pivoting mechanism and the support member. The biasing mechanism is structured and arranged to hold the antenna in the desired operating position and to move the antenna from the pivoted position to the desired operating position after removal of the external force. In some configurations, the antenna support can further comprise a mounting plate that is attached to or integral with the pivot section of the pivot mechanism so as to interconnect an antenna body of the antenna and the pivoting mechanism, hold the antenna in the desired operating position on the support member and move the antenna from the pivoted position to the desired operating position after removal of the external force. In another configuration, the antenna mount further comprises a pivot member that pivotally interconnects the pivot section and the stationary section of the pivoting mechanism. In one of the preferred configurations, the pivoting mechanism is a hinge and/or the biasing member is an elongated spring.

The first end of the biasing member can be attached to or integral with an anchor that is associated with the support member. In an embodiment where the support member is tubular, having one or more sidewalls defining a chamber, the biasing member is disposed in the chamber of the tubular support member. In this configuration, the biasing member can be elongated and be linearly disposed in the chamber of the tubular member. The first end of the biasing member can be attached to or integral with an anchor that is attached to or integral with the one or more sidewalls of the tubular support member so as to extend the anchor into or through the chamber of the tubular support member.

One use of the new antenna mount is with a motor vehicle, with the support member being associated with the vehicle so as to support the antenna mount and the antenna on the vehicle as the vehicle moves through an area having an object which applies the external force to the antenna when the object contacts the antenna. The support member can be vertically disposed with the stationary member of the pivoting mechanism attached to or integral with an upper end of the support member. The new antenna mount is particularly beneficial for use with a tractor or other vehicle that moves or is moved through an orchard or other area having trees with branches that can be the object.

Accordingly, the primary objective of the present invention is to provide an improved antenna mount for securely mounting an antenna onto a support member that has the benefits described above and elsewhere herein and which overcomes the limitations and problems that are associated with currently available apparatuses and systems for mounting an antenna onto a support member.

It is a primary objective of the present invention to provide an antenna mount that is structured and arranged to securely mount an antenna on a support member and to allow the antenna to move in response to a force being applied to the antenna in a manner which prevents damage to the antenna, antenna mount and support member and which repositions the antenna in its desired operating position.

It is also an object of the present invention to provide an antenna mount that is structured and arranged to securely mount an antenna on a support member of a vehicle and to allow the antenna to safely move as a result of contact with an object as the motor vehicle is moving through an area to prevent damage to the antenna, antenna mount and support member and then reposition the antenna in its desired operating position, which is generally upright or at least upwardly disposed relative to the support member.

It is also an object of the present invention to provide an antenna mount that is structured and arranged to securely mount an antenna on a support member of a vehicle and which can be beneficially utilized with inflexible, non-whip type of antennas, such as the multi-band omni-directional antennas commonly utilized for cellular, satellite, wifi and like communications, that are not capable of inherently flexing in response to contact with an object in order to reduce the likelihood of damage to the antenna, antenna mount and the support surface to which the antenna is mounted when a force is applied to the antenna, such as may result by the movement of a vehicle on which the antenna is mounted as the vehicle moves through an agricultural area.

An important aspect of the present invention is that it provides a new biased antenna mount for mounting an antenna on a support member which achieves the goals of the above-described objectives.

Another important aspect of the present invention is that it provides a new antenna mount for mounting an antenna on a support member which is structured and arranged to allow the antenna to move in response to a force being applied to the antenna in order to prevent or at least minimize damage to the antenna, antenna mount and support member from such force.

Another important aspect of the present invention is that it provides a new antenna mount for mounting an antenna on a support member which is particularly structured and arranged for use to mount inflexible, non-whip type of antennas, such as the multi-band omni-directional antennas commonly utilized for cellular, satellite, wifi and like communications, that are not capable of inherently flexing in response to contact with an object to prevent or at least reduce damage to the antenna as a result of a force being applied to the antenna, such as a force which results from inadvertent contact by the antenna against an object as a result of movement by the support member through an area.

Another important aspect of the present invention is that it provides a new antenna mount for mounting an antenna which is particularly structured and arranged for use to mount an inflexible, non-whip type of antenna, such as a multi-band omni-directional antenna, to a support member that is attached to or integral with a vehicle, including self-propelled, remotely-controlled or autonomous vehicles that are utilized in the agricultural industry and vehicles which are towed or pushed along a path through an area.

Another important aspect of the present invention is that it provides a new antenna mount for mounting an antenna to a support member which is particularly structured and arranged for use to mount inflexible, non-whip type of antennas, such as the multi-band omni-directional antennas that are utilized to control and/or monitor remotely-controlled and autonomous vehicles as the vehicle moves through an area to accomplish a specified task, so as to prevent or at least reduce the likelihood of damage to the antenna from inadvertent contact with an object in the area, including branches, poles, wires and the like.

Another important aspect of the present invention is that it provides a new antenna mount for securely mounting an antenna to a tubular support member associated with a moveable vehicle, whether motorized or not, and which utilizes a pivoting mechanism that controllably allows the antenna to pivot rearward in response to the antenna contacting an object as the vehicle moves through an area and a biasing mechanism which is configured to reposition the antenna back to its desired operating position, which is typically an upright or at least generally upwardly disposed position relative to the vehicle.

Another important aspect of the present invention is that it provides a new antenna mount for mounting an antenna to a support member to prevent or at least reduce damage to the antenna that is readily adaptable to a wide range of antennas, particularly the inflexible, non-whip type of antennas, such as the multi-band omni-directional antennas, that are commonly utilized for cellular, satellite, wifi and other electronic communication.

Yet another important aspect of the present invention is that it provides a new antenna mount for mounting an antenna to a support member which is easy to install and use and relatively inexpensive to manufacture so as to generally allow wide-spread use of the new antenna mount.

As will be explained in greater detail by reference to the attached figures and the description of the preferred embodiments which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. As will be readily understood and appreciated, the scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
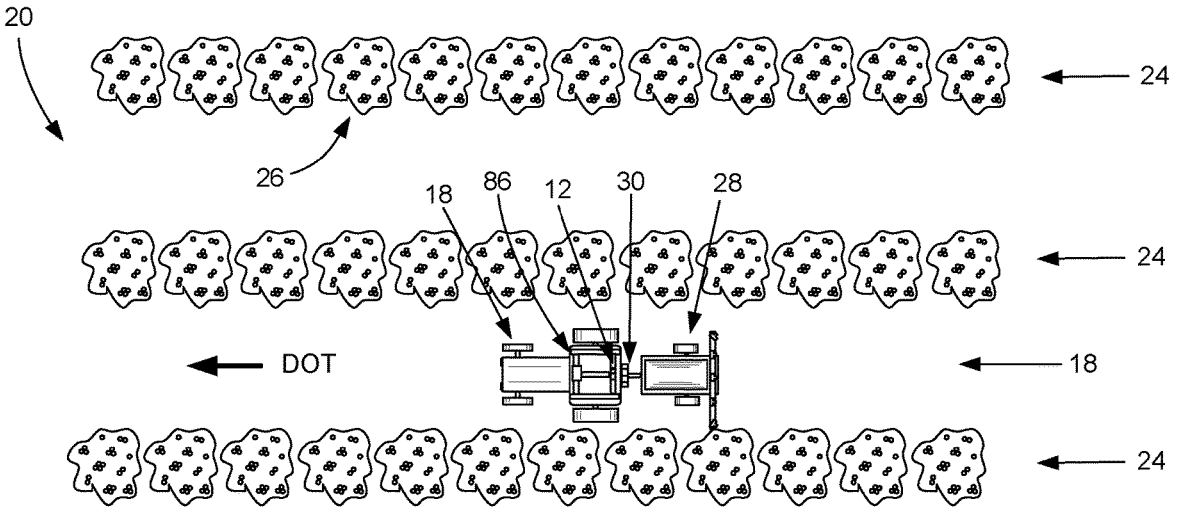
FIG. 1 is a top plan view of an agricultural area having plants that are disposed in rows with a motor vehicle towing a towed vehicle along a path between the rows of plants, with the motor vehicle being an autonomous tractor having an antenna assembly comprising an antenna mount which is configured according to a first embodiment of the present invention and an antenna.

With reference to the figures where like elements have been given like numerical designations to facilitate the reader's understanding of the present invention, the preferred embodiments of the present invention are set forth in the text below. The enclosed figures are illustrative of one or more potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the new antenna mount of the present invention and an antenna and a motor vehicle with which the antenna mount may be utilized to associate the antenna with the motor vehicle, persons who are skilled in the art will readily appreciate that the present invention is not so limited. In addition, the exemplary embodiments of the present apparatus are shown and described with only those components which are required to disclose the present invention. It may be that some of the necessary elements for attaching and using the present invention are not shown or are not necessarily described below, but which are well known to persons who are skilled in the relevant art. As will be readily appreciated by such persons, the various elements of the present invention that are described below may take on any form consistent with those forms which are readily realized by persons of ordinary skill in the art having knowledge of support members, pivoting mechanisms, biasing mechanisms, antennas and vehicles, including driver/operator operated vehicles, remotely-controlled vehicles, autonomous vehicles and towed or pushed vehicles. For instance, the apparatus of the present invention can be removably or fixedly attached to a support member of a vehicle or be integrally formed therewith and the motor vehicle and antenna may have virtually any configuration consistent with the attributes of the antenna mount of the present invention.

An antenna mount that is configured pursuant to one of the preferred embodiments of the present invention is shown generally as 10 in FIGS. 3-12. As described in more detail below and best shown in FIGS. 1-5, the new antenna mount 10 is part of an antenna assembly 12, which includes an antenna 14, that is mounted to a support member 16. In the embodiment shown in the figures, the support member 16 is attached to or integral with a vehicle 18 so the antenna 14 may be beneficially utilized to operate or monitor the vehicle 18 or by one or more persons who are inside the vehicle 18. As will be readily appreciated by persons who are skilled in the art, use of the antenna mount 10 of the present invention is not limited to use with a vehicle 18, as the antenna mount 10 may also be utilized to securely mount an antenna 14 to a support member 16 which is associated with a non-moving structure, including buildings, posts and the like, where the features of the new antenna mount 10 can benefit safe and efficient use of the antenna 14.

Figure 2:
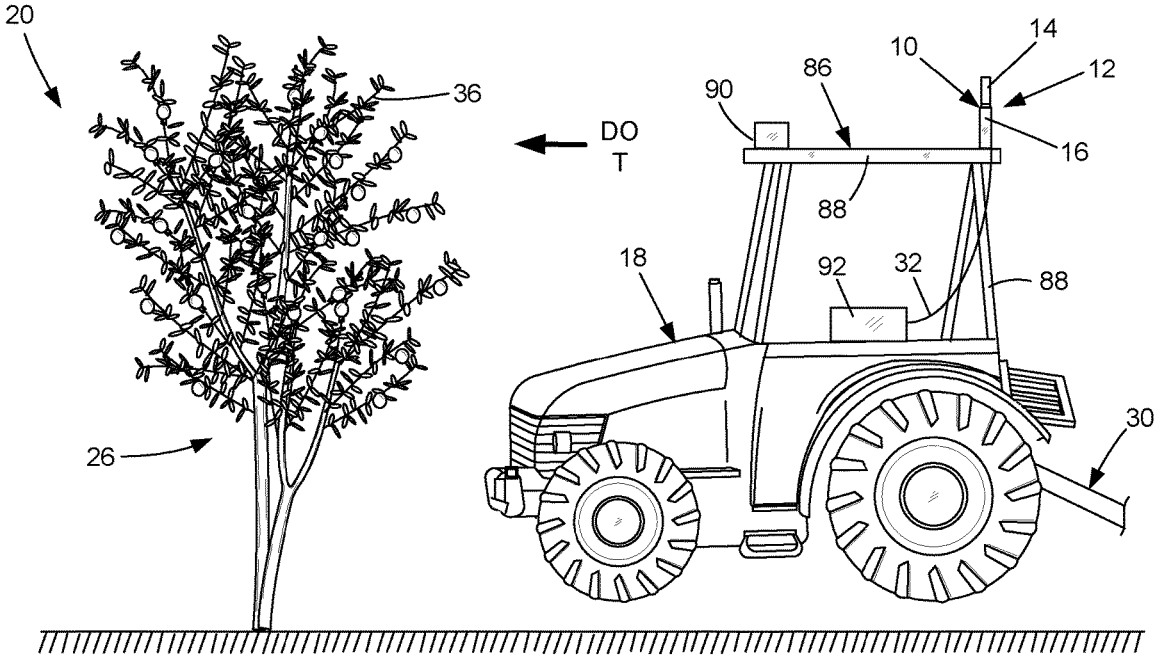
FIG. 2 is a left side view of the tractor, antenna assembly and antenna mount of FIG. 1 approaching alongside one of the plants of FIG. 1 having an object which could contact the antenna.
Figure 3:
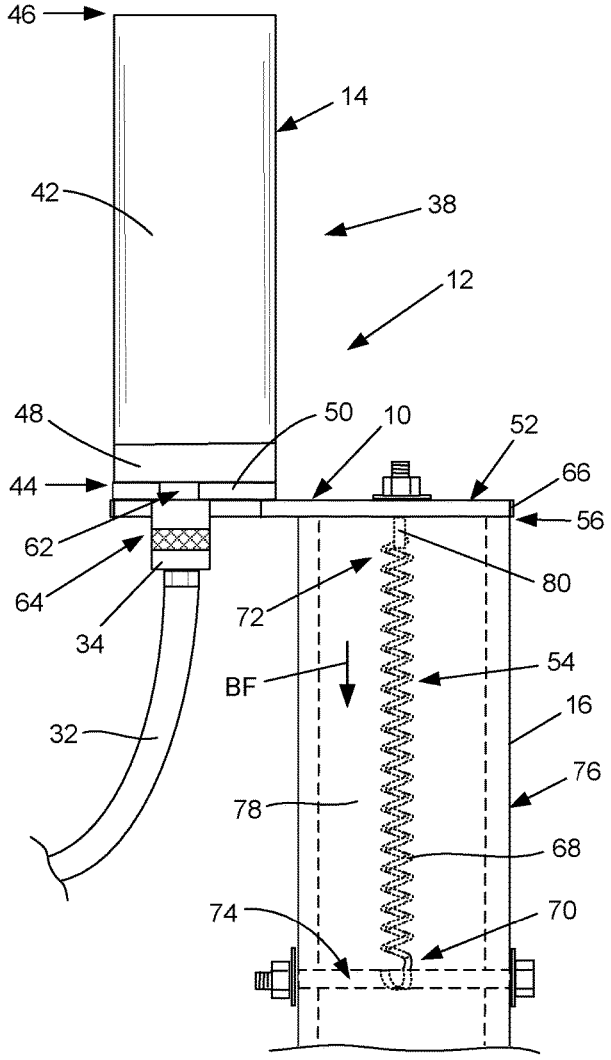
FIG. 3 is a front view of the antenna assembly of FIG. 1 showing the antenna mount of the present invention securely mounting the antenna to a tubular support member associated with the vehicle, with the antenna in its desired operating position.
Figure 4:
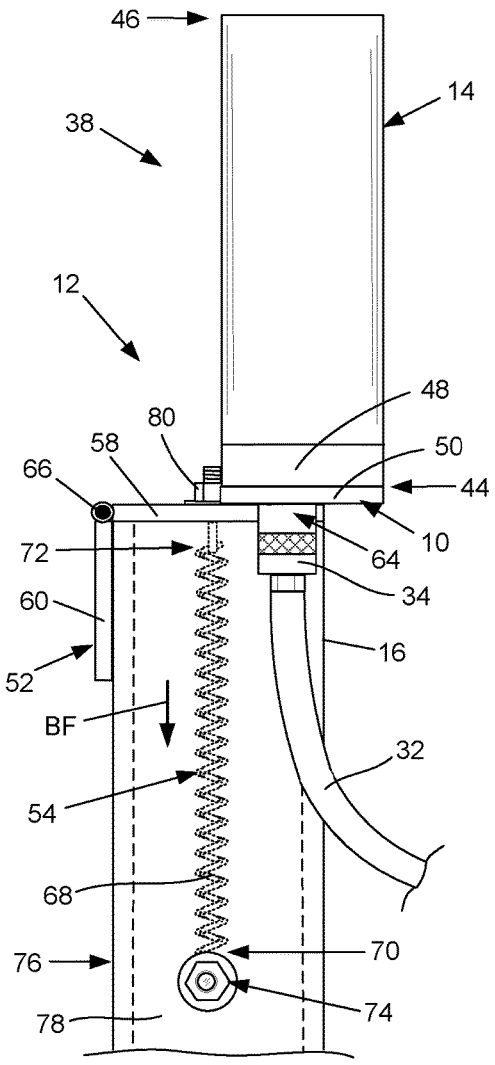
FIG. 4 is a left side view of the antenna assembly of FIG. 3.
Figure 5:
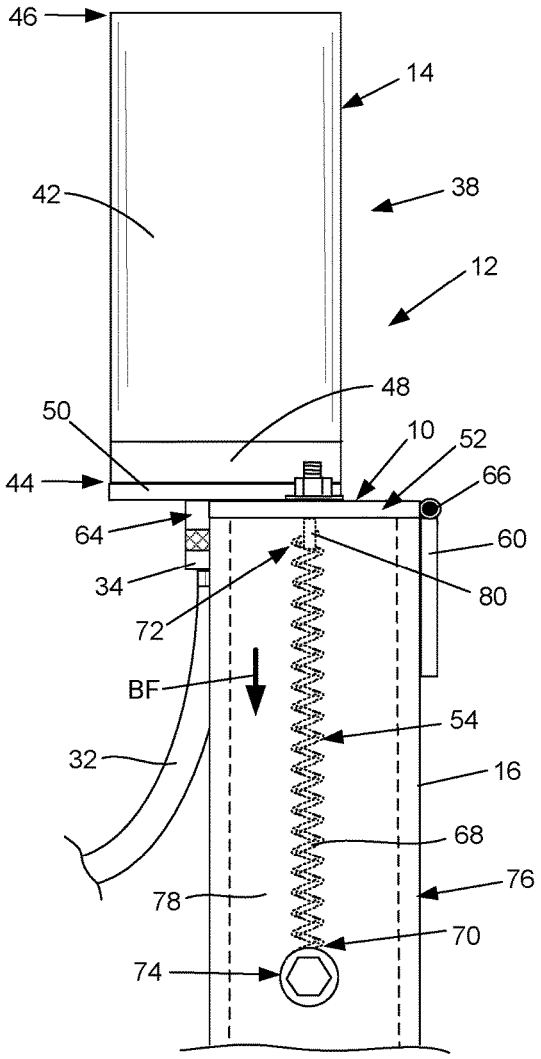
FIG. 5 is a right side view of the antenna assembly of FIG. 3.

In one particularly beneficial use of the new antenna mount 10 of the present invention, the antenna mount 10 is utilized to mount an antenna 14 to a support member 16 associated with a remote controlled or autonomous vehicle 18 that is configured to move through an agricultural area 20 along a path 22 between rows 24 of plants 26, such as the trees shown in FIGS. 1-2. In the exemplary use of the new antenna mount 10 shown in FIG. 1, the antenna mount 10 is utilized to mount an antenna 14 to an autonomously operated tractor (as the vehicle 18) as it tows a towed vehicle 28, which is shown as a sprayer that is connected to the tractor 18 by a towing assembly 30, along the path 22 in a particular direction of travel (DOT). As such, the antenna 14 that is shown in FIGS. 2-7 and 10-12 is of the type which is specially configured for use with electronic communications necessary to operate an autonomous vehicle 18 (likewise for remotely-controlled vehicles 18). These antennas 14 are of the type which are multi-band, omni-directional antennas that are utilized for cellular, satellite, wifi and other electronic communication. The antenna 14 connects to the relevant electronic components of vehicle 18, as an example use, via an electronic communication cable 32, as shown in FIGS. 2-7 and 10-12. The cable 32 is often attached, but not exclusively, with a threaded connector 34 that removably connects to a cooperatively configured connector (not shown) of the antenna 14 in order to transmit electronic signals between the antenna 14 and the electronic components for which the antenna 14 is being utilized (i.e., to operate and/or monitor vehicle 18). In some antenna configurations, the cable 32 is fixedly connected to the antenna 14. The configuration and use of such antennas, cables and electronic components and are generally well known to persons who are skilled in the relevant art.

Figure 6:
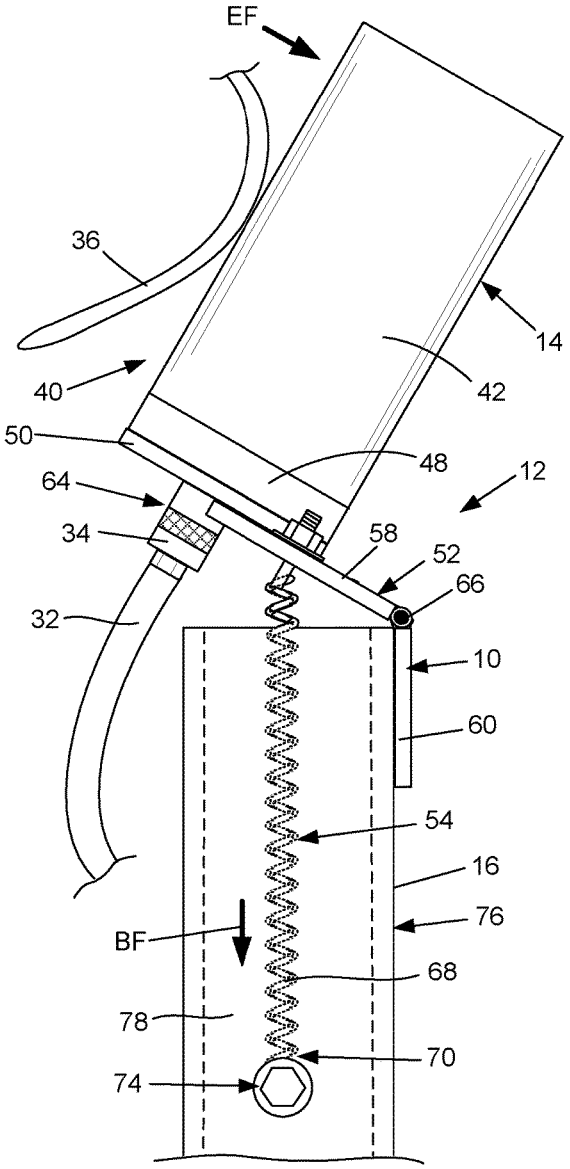
FIG. 6 is a right side view of the antenna assembly of FIG. 3, with the antenna being hit by an object that applies an external force to move the antenna to its pivoted position.
Figure 7:
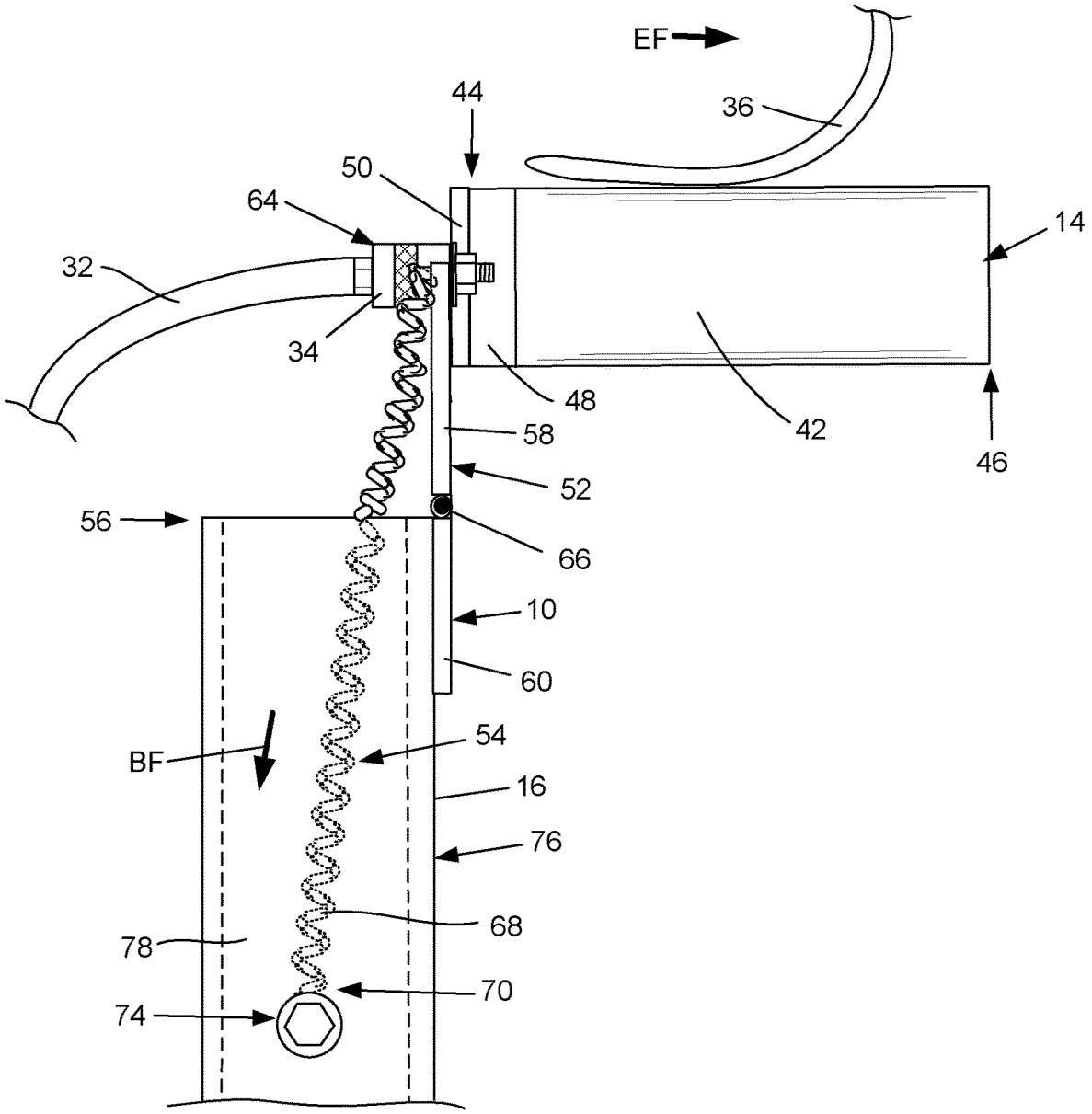
FIG. 7 is a right side view of the antenna assembly of FIG. 6 showing the object further moving the antenna to its pivoted position.
Figure 8:
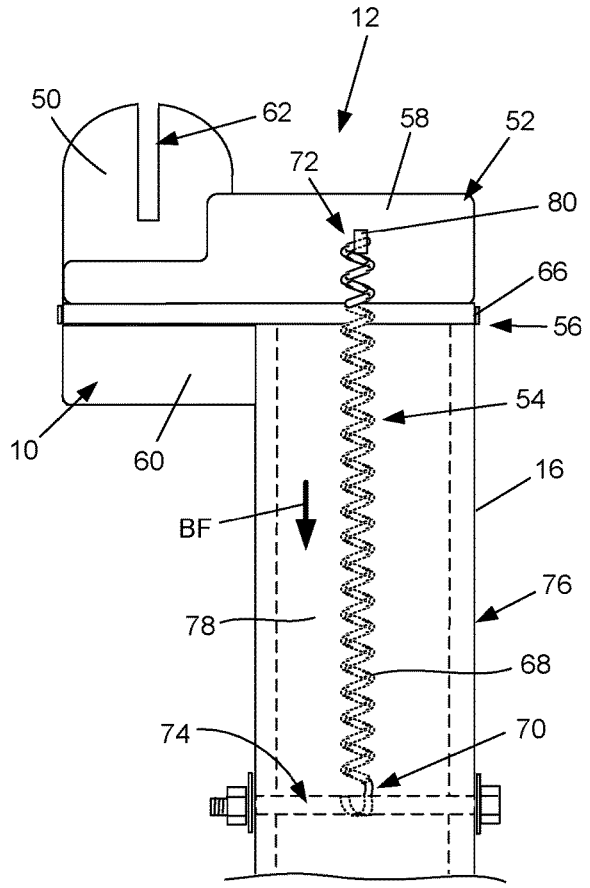
FIG. 8 is a front view of the antenna assembly of FIG. 3 shown without the antenna, cable and cable connector to better illustrate the antenna mount of the present invention.

Unlike the whip-type antennas, which primarily comprise a flexible elongated rod, the type of antenna 14 shown in FIGS. 3-7 and 10-12 are not flexible and, as such, they will not bend or flex in response to the application of an external force EF, such as will occur if the antenna 14 contacts an object 36, such as the tree branch shown in FIGS. 6-7, as the vehicle 18 moves through area 20. Unless a specially configured antenna mount, such as new antenna mount 10, is utilized to mount the antenna 14 to the support member 16, an external force EF resulting from contact with the object 36 can damage the antenna 14, antenna mount 10 and/or support member 16. As shown with regard to FIGS. 6-7, when the antenna 14 contacts an object 36, the new antenna mount 10 will move the antenna 14 from its normal or desired operating position 38 (FIGS. 3-5 and 10-12), which is typically an upright position (i.e., vertically disposed) or a generally upwardly disposed position, to a pivoted position 40 (FIGS. 6-7), which is typically rearwardly directed relative to the direction of travel DOT, in order to prevent or at least substantially reduce the likelihood of damage to the antenna 14, antenna mount 10 and/or support member 16 and then return the antenna 14 back to the desired operating position 38 after the antenna 14 passes by the object 36 and is no longer in danger of being damaged by the object 36.

Figure 10:
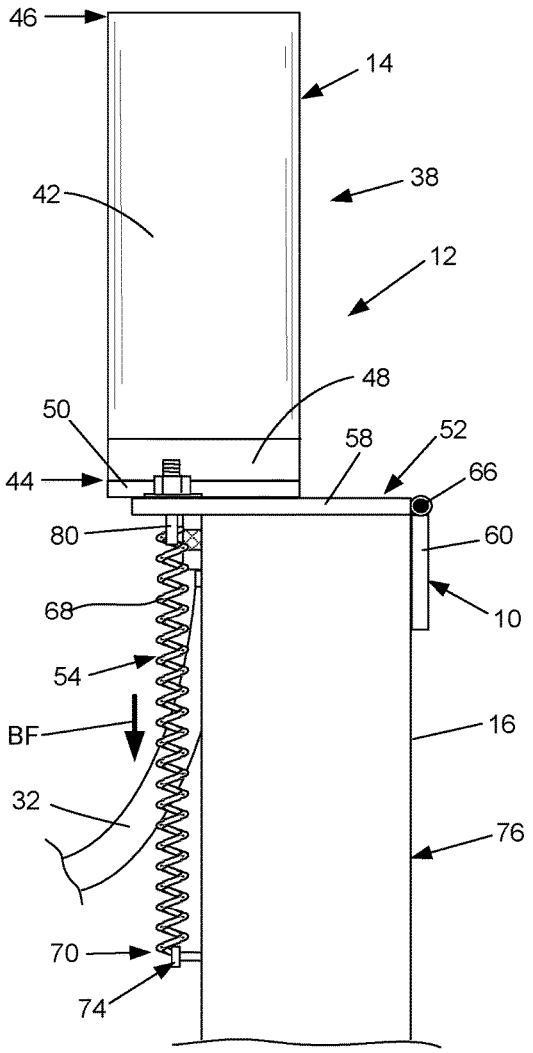
FIG. 10 is a right side view of an antenna assembly having an antenna mount which is configured according to a second embodiment of the present invention with the biasing mechanism positioned outside a sidewall of the support member.
Figure 11:
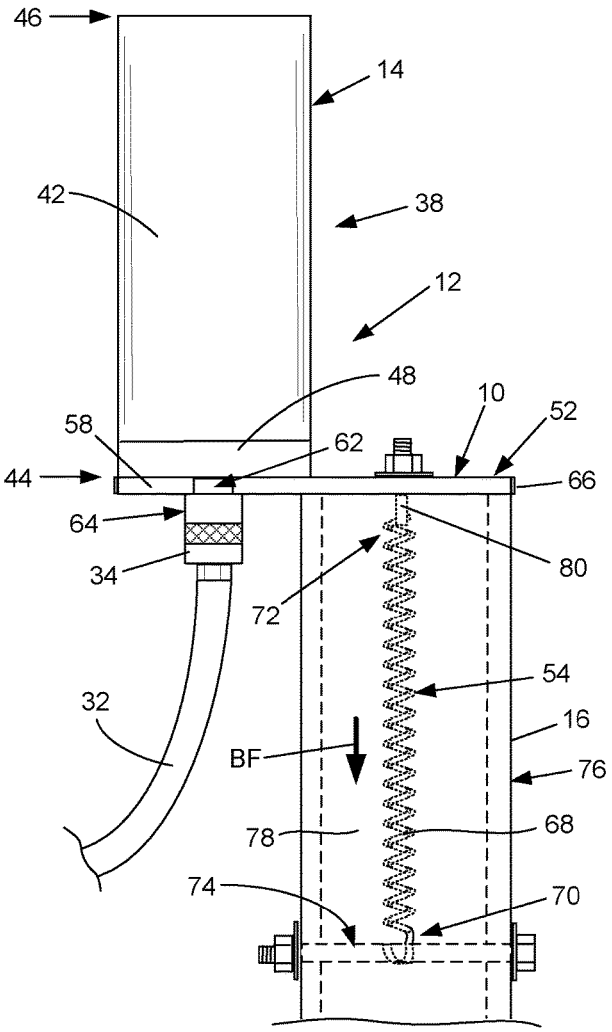
FIG. 11 is a right side view of an antenna assembly having an antenna mount which is configured according to a third embodiment of the present invention with the antenna mount being integral with the pivot section of the pivoting mechanism.
Figure 12:
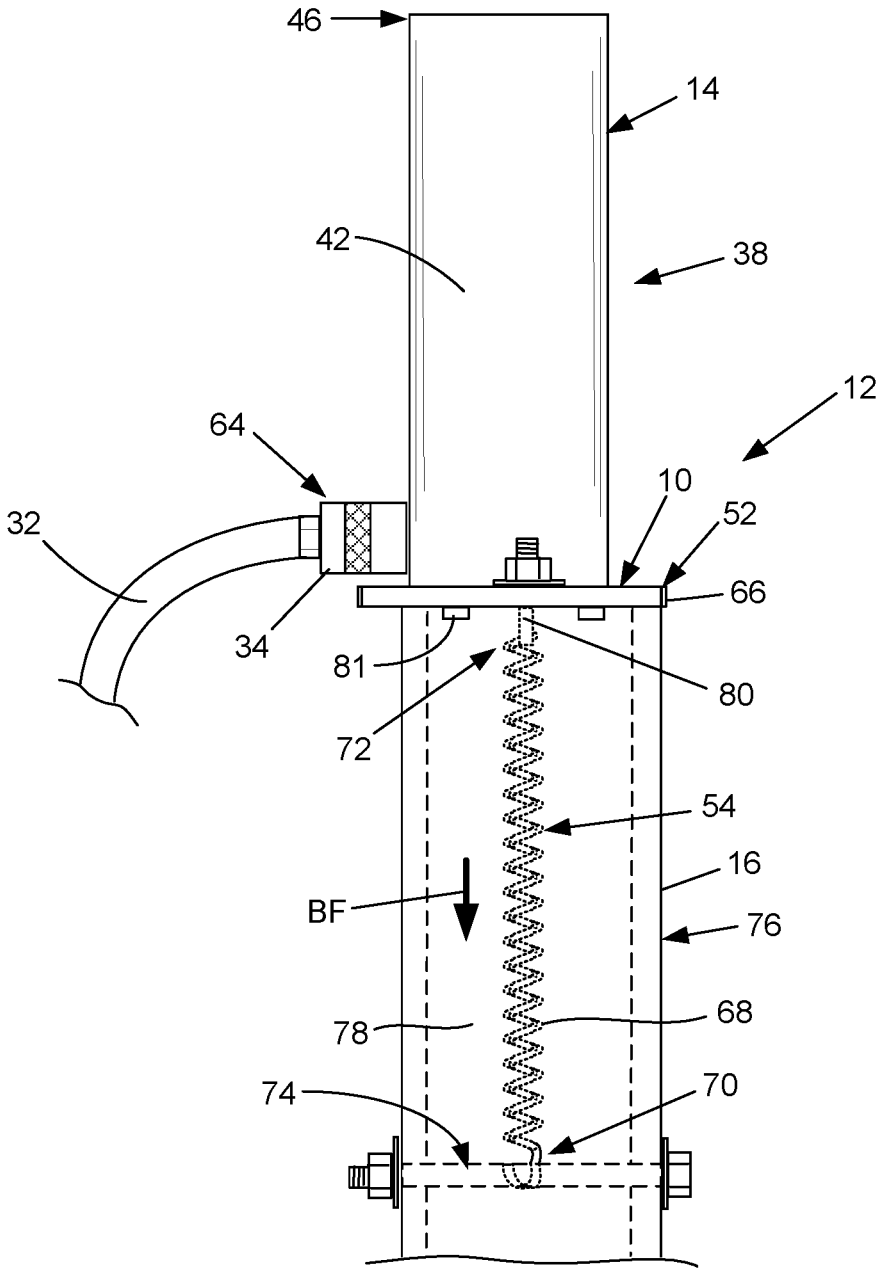
FIG. 12 is a right side view of an antenna assembly having an antenna mount which is configured according to a fourth embodiment of the present invention with the antenna not having a base and the cable being connected at the side of the antenna body.

The antenna 14 shown in the figures has an elongated antenna body 42 with a first or lower end 44 and a second or upper end 46, with a base portion 48 at the first/lower end 44, as best shown in FIGS. 3-7 and 10-12. The base portion 48 may be a separate component in which the first/lower end 44 of the antenna body 42 is received (as shown) or it may integral with the first/lower end 44 of the antenna body 42. In the embodiment of the new antenna mount 10 and antenna 14 set forth herein and shown in the figures, the base portion 48 of the antenna 14 is placed in abutting relation with the new antenna mount 10. In embodiments in which the antenna 14 does not have a separate base portion 48, such as shown in FIG. 12, the first/lower end 44 of the antenna body 42 may directly be in abutting relation with the antenna mount 10. As will be readily appreciated by persons who are skilled in the art, it is not necessary that the antenna 14 be configured as shown in the figures. In fact, the new antenna mount 10 can be utilized with an antenna 14 that is of the whip-type antenna or a variety of other configurations of antennas.

For purposes of describing the present invention, terms such as "top", "upper", "upward", "upwardly" and the like and terms such as "bottom", "lower", "downward", "downwardly" and the like are utilized in reference to the new antenna mount 10 and the antenna 14 when the antenna 14 is vertically arranged, such as shown in FIGS. 3-5 and 10-12. As also utilized herein, the terms "front", "forward", "forwardly" and the like are utilized herein to refer to or toward what is normally considered the front end of the vehicle 18 as it moves in the direction of travel DOT and the terms "back", "rearward", "rearwardly" and the like are utilized herein to refer to or toward what is normally considered the back end of the vehicle 18 or in a direction that is opposite of the direction of travel DOT. As will be readily appreciated by persons who are skilled in the art, these terms are utilized herein to be able to describe the features of the present invention so it can be more easily understood by the reader and, as such, it is not necessary that these components be arranged as illustrated in the figures.

In a preferred embodiment, the antenna mount 10 of the present invention generally comprises a mounting plate 50, a pivot mechanism 52 and a biasing mechanism 54, as shown in FIGS. 3-8 and 10-12. In the embodiment shown in the figures, the first/lower end 44 of the antenna 14 is secured to, attached to or integrally formed with the mounting plate 50, the pivoting mechanism 52 is attached to or integral with the mounting plate 50 and the support member 16 so as to be secured to the vehicle 18 and to allow the mounting plate 50 (and, therefore, the antenna 14) to pivot rearwardly and forwardly between the antenna's desired operating position 38 and its pivoted position 40, and the biasing mechanism 54 is attached to or integral with the pivoting mechanism 52 so as to apply a biasing force BF that holds the antenna 14 in its desired operating position 37 during normal operation and to pull the antenna 14 back to its desired operating position 38 after passing by the object 36 that resulted in an external force EF being applied to the antenna 14. As shown in FIGS. 3-9 and 10-11, the pivoting mechanism 52 pivotally interconnects the mounting plate 50 and the support member 16 at the upper end 56 thereof (in the embodiment shown in the figures where the support member 16 is vertically disposed), with the mounting plate 50 connected to a pivot section 58 of the pivoting mechanism 52 and a stationary section 60 thereof connected to the support member 16. In operation, the biasing mechanism 54 of the antenna mount 10 pulls downward on a pivoting portion of the pivoting mechanism 52 and, therefore, the mounting plate 50 to hold the antenna 14 in its desired operating position 38 as vehicle 18 moves through the area 20 along the path 22 in the direction of travel DOT, as shown in FIGS. 1-5. When the antenna 14 hits an object 36, the contact causes an external force EF that pushes against the antenna 14, as shown in FIGS. 6-7. If the external force EF is greater than the biasing force BF of the biasing mechanism 54, the pivoting mechanism 52 will allow the mounting plate 50, a portion of the pivoting mechanism 52 and the antenna 14 to pivot rearward, thereby moving antenna 14 to the pivoted position 40 shown in FIGS. 6-7. As the vehicle 18 continues moving forward in the direction of travel DOT, the antenna 14 will pass by the object 36, thereby removing the external force ET, at which time the biasing force BF provided by the biasing mechanism 54 will pull the pivoting portion of pivoting mechanism 52 downward, which will pivot the mounting plate 50 and antenna 14 forward and downward against the upper end 56 of support member 16 to reposition the antenna 14 in its desired operating position 38.

The mounting plate 50 is structured and arranged to interconnect the antenna 14 and the pivoting mechanism 52 such that the antenna 14 will pivot rearwardly and forwardly in response, respectively, to the antenna 14 contacting the object 36 and the biasing force BF applied by the biasing mechanism 54 after passing by the object 36. In the embodiments shown in the figures, the mounting plate 50 is a separate plate or plate-like component that is attached to the pivot section 58 of the pivoting mechanism 50 so as to be pivoted thereby and the base portion 48 of the antenna 14, which is at the first/lower end 44 of the antenna body 42, is secured to the mounting plate 50 so as to also be pivoted by the pivoting mechanism 52, as shown in FIGS. 6-7. In other embodiments, the first/lower end 44 of antenna body 42 is attached directly to the pivoting mechanism 52. In some embodiments, the mounting plate 50 can be integral with the pivot section 58, or another pivoting component, of pivoting mechanism 52, as shown in FIG. 12.

The mounting plate 50 can be adapted in any manner necessary to be cooperatively configured with the antenna 14 so the base 48 or first/lower end 44 thereof can be attached to the mounting plate 50. In the figures, the mounting plate 50 is provided with a mounting aperture 62, which is in the form of slot in the embodiment shown, that is sized and configured to allow the attachment of the cable 32, by the connector 34, to the antenna 14 to function as an attachment mechanism 64 that securely attaches the antenna 14 to the mounting plate 50, as best shown in FIGS. 3-4, 7-9 and 11. More specifically, attaching the connector 34 to the antenna 14 at the mounting aperture 62 functions as a clamp that securely holds the antenna 14 on the mounting plate 50 by clamping the mounting plate 50 between the connector 34 and the base 48 or the first/lower end 44 of the antenna body 42. As will be readily appreciated by persons who are skilled in the relevant art, the mounting aperture 62 has a width or diameter sufficient to accomplish the attachment objective (i.e., for the male cable mounting portion of the antenna 14 to extend through the mounting aperture 62) and the mounting aperture 62 must have a width or diameter that is sufficiently smaller than the width or diameter of the connector 34 to provide the clamping necessary to hold the antenna 14 in place. In other embodiments, the mounting aperture 62 can be a circular hole that is sized and configured to accomplish the same connecting and mounting objectives. In other embodiments, the attachment mechanism 64 that securely attaches the antenna 14 to the mounting plate 50 can be an adhesive or bolts, screws and like connectors, as shown in FIG. 12, or by welding and other methods appropriate for the relevant materials of the mounting plate 50 and antenna 14 (or at least the base 48 or first/lower end 44 thereof). Although the mounting plate 50 can be made out of virtually any suitable material, for use with a remotely-controlled or autonomous vehicle 18 the mounting plate 50 will typically be made out of a relatively strong, rigid and corrosion-resistant material, such as powder-coated steel or the like.

As set forth above, the pivoting mechanism 52 is structured and arranged to allow the mounting plate 50 (and, therefore, the antenna 14) to pivot rearwardly to prevent or at least reduce the likelihood of damage to the antenna 14 in response to the external force EF from contact with an object 36 and to pivot forwardly to reposition the antenna 14 back to its desired operating position 38. In the embodiment shown in the figures, the pivot mechanism 54 comprises the pivot section 58, stationary section 60 and a pivot member 66 that pivotally connects the pivot section 58 to the stationary section 60, as best shown in FIGS. 5-7 and 10. For purposes of describing the attributes and function of the present invention, the pivot section 58 is that portion of the pivoting mechanism 54 that pivotally moves rearwardly and forwardly and the stationary section 60 is that portion of the pivoting mechanism 54 that is fixedly attached to the support member 16 and relative to which the pivot section 58 pivots. The pivot member 66 can be a pin, rod or the like that interconnects the two sections 58/60 of the pivoting mechanism 54. In the embodiment shown in the figures, the pivoting mechanism 54 is a hinge that allows the pivot section 58 to move freely in the generally rearward and forward directions so as to move the antenna 14 between its desired operating position 38 and pivoted position 40, as shown in relation to FIGS. 5-7. In other embodiments of the new antenna mount 10, the pivoting mechanism 54 can be of the type that is commonly referred to as or having a "living hinge" whereby the two sections 58/60 are integrally formed, thereby eliminating the need for the separate pivot member 66. The configuration and use of such living hinges are well known to persons skilled in the relevant arts. Due to the use of the biasing mechanism 54, it is not necessary for the pivot mechanism 54 to have a spring or any significant spring-like features. As with the mounting plate 50, although the pivot mechanism 50 can be made out of virtually any material, the use of a strong, rigid and corrosion-resistant material, such as powder-coated steel or the like, is generally preferred for use with a remotely-controlled or autonomous vehicle 18.

As also set forth above, the biasing mechanism 54 is structured and arranged to provide a biasing force BF that moves the antenna 14 back to its desired operating position 38 after the antenna 14 is controllably pivoted rearward (i.e., not break apart or fly off of the vehicle 18 due to pivoting mechanism 52) as a result of an external force EF resulting from contact with an object 36 as the vehicle 18 moved along the path in the direction of travel DOT, as shown with regard to FIGS. 3-5 and 6-7. As such, the biasing force BF must be sufficient to pivot the pivoting mechanism 52, mounting plate 50 and antenna 14 from the antenna's pivoted position 40 back to its desired operating position 38. The biasing mechanism 54 comprises a biasing member 68 having a first or lower end 70 and a second or upper end 72, with the first/lower end 70 attached to or integral with a stationary anchor 74 and the second/upper end 72 attached to or integral with the pivot section 58 of the pivoting mechanism 52, as best shown in FIGS. 3-8 and 10-12. In the embodiment shown in the figures, the anchor 74 is associated with the support member 16. In the embodiment shown in the figures, the antenna mount 10 is mounted on a tubular-shaped, elongated support member 16 having a plurality of sidewalls 76 that define an enclosed chamber 78. In this embodiment, the biasing member 68 is a spring that is linearly disposed inside the chamber 78, the anchor 74 is a bolt, rod or the like that extends across opposite sidewalls 76, the first/lower end 70 of the biasing member 68 engages the anchor 74 inside the chamber 78 and the second/upper end 72 of the biasing member 68 is connected to the pivot section 58 of the pivoting mechanism 52 by an eye bolt, washer and nut other connecting device 80 attached to or integral with the pivot section 58 (which is also inside the chamber 78 when the antenna 14 is in its desired operating position 38), as best shown in FIGS. 3-5, 8 and 10-12. The spring or spring-like biasing member 68 connecting the anchor 74 and the pivot section 58 of the pivoting mechanism 52 is selected to provide the biasing force BF necessary to hold the antenna 14 in its desired operating position 38 during normal operation and move the antenna 14 from its pivoted position 40 back to its desired operating position 38 after the antenna 14 has passed by the object 36 that provided the external force EF sufficient to move the antenna 14 to its pivoted position 40.

As will be readily appreciated by persons who are skilled in the art, there are a wide variety of alternative configurations for the biasing mechanism 54 that can be utilized with the anchor mount 10 of the present invention. In one such alternative configuration, the support member 16 is not tubular and, as such, the biasing member 68 does not linearly extend inside a (non-existent) chamber 78. In such a configuration, the biasing member 68 can extend along the outer surface of one of the sidewalls 76 of the support member 16, as shown in FIG. 11. In another alternative configuration, the biasing member 68 can be other than an elongated spring, such as an elastic member made out of rubber or the like that is capable of providing the necessary biasing force BF to pull the pivot section 58, mounting plate 50 and antenna 14 to place the antenna 14 in its desired operating position 38. Likewise, the anchor 74 could be an eye-bolt or the like that is only attached to one of the sidewalls 76 of the support member 16 or the anchor 74 could be an aperture or other device in or associated with one of the sidewalls 76 of the support member 16 such that the first/lower end 70 of the biasing member 68 is attached to the eye-bolt, aperture or other anchor 74. In any configuration, the first/lower end 70 of the biasing member 68 should be held in place so as to allow the biasing member 68 to provide the required biasing force BF to hold the antenna 14 in its desired operating position 38 during normal use or to move the antenna 14 back to its desired operating position 38 from the pivoted position 40 after the antenna 14 has passed by the object 36 that provided the external force EF which pushed the antenna 14 to the pivoted position 40. The second/upper end 72 of the biasing member 68 can be attached to or integral with the pivot section 58 of the pivoting mechanism 52 or it can be attached in a wide variety of different ways other than the eye-bolt, washer and nut connecting device 80 shown in the figures, including the use of pins, screws and the like or the use of an aperture, loop or other device that is incorporated into or integrally formed with the lower surface of the pivot section 58 of pivoting mechanism 52.

An alternative embodiment for the antenna mount 10 of the present invention is shown in FIGS. 11-12. In this embodiment, the antenna mount 10 does not utilize a separate mounting plate 50. Instead, the pivot section 58 of the pivoting mechanism 52 is sized and configured to extend sufficiently forward to be able to support the antenna 14 thereon. The base portion 48 or the first/lower end 44 of the antenna body 42 is attached to or formed integrally with the larger sized pivot section 58. In one configuration, shown in FIG. 11, the pivot section 58 (as also the mounting plate 50) has the mounting aperture 62 that is utilized as the attachment mechanism 64 to attach the antenna 14 to the pivoting mechanism 52 by using the cable connector 34 to clamp, as set forth above, the antenna 14 to the pivot section 58 of the pivoting mechanism 52. In the embodiment of FIG. 12, the cable 32 and cable connector 34 extend out of the side of the antenna body 42 and the base portion 48 or the first/lower end 44 of the antenna body 42 is secured to the pivoting mechanism 52 using screws, bolts or like connecting elements 81 (as the attachment mechanism 64).

Figure 9:
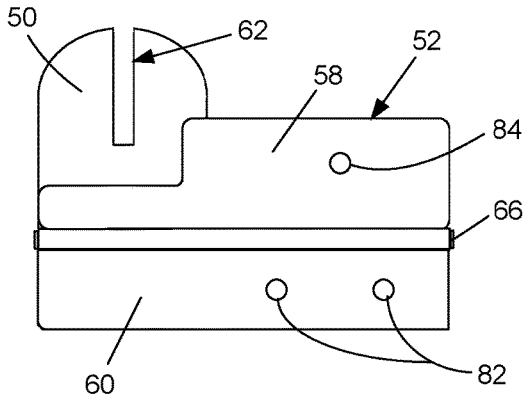
FIG. 9 is a front view of the mounting plate and pivot mechanism of the antenna mount of FIG. 8.

With regard to the embodiment shown above, the stationary section 60 of the biasing mechanism 52 of the new antenna mount 10 is attached to a sidewall 76 of the tubular support member 16 using bolts or screws placed through the mounting apertures 82 in the stationary section 60 and the pivot section 58 is secured to the biasing member 68 of the biasing mechanism 54 using an eye bolt or the like through the mounting aperture 84 in the pivot section 58, as shown in FIGS. 3-12 (with the apertures 82/84 shown in FIG. 9). The support member 16 is either an integral part of the vehicle 18 or the support member 16 is securely attached to the vehicle 18. In the embodiment shown in the figures, the support member 16 is associated with a frame 86, having a plurality of frame members 88, that is also utilized to support the data gathering equipment 90, typically comprising devices such as LIDAR, cameras, sonar and the like, that is utilized to guide or help guide a remotely-controlled or autonomous vehicle 18, as shown in FIGS. 1-2. As described above, the cable connector 34 of the cable 32 can be utilized as the attachment mechanism 64 that securely attaches the antenna 14 to the new antenna mount 10. Alternatively, as shown in FIG. 12, screws, bolts or other appropriate connecting elements 81 can be utilized to secure the antenna 14 to the antenna mount 10. In the embodiment shown in FIG. 2, the opposite end of the cable 32 is attached to an on-board operating system having a computer 92 or the like that assists with the operation and monitoring of the vehicle 18 so that electronic signals and be transferred between the antenna 14 and to the computer 92 as necessary or beneficial for the operation of the vehicle.

With the new antenna mount 10 in use to safely and securely mount an antenna 14 on a vehicle 18 while the vehicle 18 is moving along a path 22 through an area 20 having a plurality of rows 24 of plants 26, as shown in FIG. 2, an object 36 (such as a branch of tree) may make contact with the antenna 14, as shown in FIGS. 6 and 7. Normally, such contact could damage the antenna 14, the prior art antenna mount or even a component of the vehicle 18. Using the new antenna mount 10 of the present invention, the external force EF of the object 36 will cause the antenna 14 to pivot rearward, which will prevent or at least reduce the likelihood of the antenna 14, antenna mount 10 or a component of the vehicle 18 being damaged by the object 32. As will be readily appreciated by persons who are skilled in the relevant art, normally the biasing force BF provided by the biasing mechanism 54 holds the antenna 14 in its desired operating position 38, which is shown as vertically disposing the antenna 14 in an upright position in FIGS. 3-5 and 10-12. When the antenna 14 hits an object 36 that is substantial enough to result in an external force EF greater than the biasing force BF, such contact will move the antenna 14 to its pivoted position 40, as shown in FIGS. 6-7. Depending on the nature of the object 36 and contact with the antenna 14, the antenna 14 may move to a pivoted position 40 that is only partially pivoted (FIG. 6) or it may move to a position which is fully pivoted over (FIG. 7). In any degree of pivoting, the pivoting mechanism 52 is structured and arranged to allow the antenna to safely and controllably respond to the contact with object 36 instead of being damaged by the contact. After the antenna 14 passes by the object 36, the biasing force BF provided by the biasing member 68 of the biasing mechanism 54 will bias the pivot section 58 of the pivoting mechanism 52 forward to reposition the antenna 14 in its desired operating position 38.

As will be readily appreciated by persons who are skilled in the art, the antenna mount 10 is subject various modifications, can be utilized with different types of antennas 14 and in a wide variety of antenna mounting situations. For instance, although the figures primarily show the attachment mechanism 64 being the connector 34 of the cable 32 being secured to the mounting plate 50 or to the pivot section 58 of the pivot mechanism 52, a variety of other types of devices and configurations can be utilized to secure the antenna 14 to the pivot mechanism 52, such as the connecting elements 81 shown in FIG. 12. For instance, the antenna 14 could be fixedly attached to the pivot mechanism 52 or secured by welding or using adhesives, as may be appropriate depending on the subject materials. In addition, although the support member 16 is primarily shown as tubular and the biasing member 68 is inside the chamber 78 defined by the sidewalls 76, the support member 16 could not be tubular and, therefore, the biasing member 68 would be along the surface of the support member 16, as shown in FIG. 10. The new antenna mount 10 could be utilized with driver-operated vehicles 18 and it could be used to mount an antenna 14 to a wide variety of structures, including a building, pole, fence, wall or the like as may be beneficial or necessary to prevent damage to an antenna 14.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor(s) and to enable other persons who are skilled in the relevant art to make and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. An antenna mount for mounting an antenna to a support member, said antenna mount comprising:

a pivoting mechanism interconnecting the antenna and the support member, said pivoting mechanism having a pivot section attached to or integral with the antenna and a stationary section attached to or integral with the support member, said pivoting mechanism structured and arranged to support the antenna in a desired operating position and allow the antenna to move to a pivoted position in response to an external force applied to the antenna; and a biasing mechanism having a biasing member with a first end attached to or integral with the support member and a second end attached to or integral with said pivot section so as to interconnect said pivoting mechanism and the support member, said biasing mechanism structured and arranged to hold the antenna in the desired operating position and to move the antenna from the pivoted position to the desired operating position after removal of the external force.

2. The antenna support of claim 1 further comprising a mounting plate attached to or integral with said pivot section of said pivot mechanism so as to interconnect an antenna body of the antenna and said pivoting mechanism, hold the antenna in the desired operating position on the support member and move the antenna from the pivoted position to the desired operating position after removal of the external force.

3. The antenna mount of claim 1 further comprising a pivot member pivotally interconnecting said pivot section and said stationary section of said pivoting mechanism.

4. The antenna mount of claim 3, wherein said pivoting mechanism is a hinge.

5. The antenna mount of claim 1, wherein said biasing member is an elongated spring.

6. The antenna mount of claim 1, wherein said first end of said biasing member is attached to or integral with an anchor associated with the support member.

7. The antenna mount of claim 1, wherein the support member is tubular with one or more sidewalls defining a chamber, said biasing member disposed in the chamber of the tubular support member.

8. The antenna mount of claim 7, wherein said biasing member is elongated and linearly disposed in the chamber of the tubular member.

9. The antenna mount of claim 8, wherein said first end of said biasing member is attached to or integral with an anchor attached to or integral with the one or more sidewalls of the tubular support member so as to extend the anchor into or through the chamber of the tubular support member.

10. The antenna mount of claim 1, wherein the support member is associated with a vehicle so as to support said antenna mount and the antenna on the vehicle as the vehicle moves through an area having an object which applies the external force to the antenna when the object contacts the antenna.

11. The antenna mount of claim 10, wherein the support member is vertically disposed and said stationary member of said pivoting mechanism is attached to or integral with an upper end of the support member.

12. An antenna mount for mounting an antenna to a support member, said antenna mount comprising:

a mounting plate attached to or integral with the antenna;

a pivoting mechanism interconnecting said mounting plate and the support member, said pivoting mechanism having a pivot section attached to or integral with said mounting plate and a stationary section attached to or integral with the support member, said pivoting mechanism structured and arranged to support the antenna in a desired operating position and allow said mounting plate and the antenna to move to a pivoted position in response to an external force that is applied to the antenna; and a biasing mechanism having an elongated biasing member with a first end attached to or integral with an anchor associated with the support member and a second end attached to or integral with said pivot section so as to interconnect said pivoting mechanism and the support member, said biasing mechanism structured and arranged to hold the antenna in the desired operating position and to move the antenna from the pivoted position to the desired operating position after removal of the external force.

13. The antenna mount of claim 12 further comprising a pivot member pivotally interconnecting said pivot section and said stationary section of said pivoting mechanism.

14. The antenna mount of claim 13, wherein said pivoting mechanism is a hinge.

15. The antenna mount of claim 12, wherein said biasing member is an elongated spring.

16. The antenna mount of claim 12, wherein the support member is tubular with one or more sidewalls defining a chamber, said biasing member being elongated and linearly disposed in the chamber of the tubular support member.

17. The antenna mount of claim 16, wherein the anchor is attached to or integral with the one or more sidewalls of the tubular support member so as to extend into or through the chamber of the tubular support member.

18. The antenna mount of claim 12, wherein the support member is associated with a vehicle so as to support said antenna mount and the antenna on the vehicle as the vehicle moves through an area having an object which applies the external force to the antenna when the object contacts the antenna.

19. An antenna assembly, comprising:

a vertically disposed, elongated tubular support member having one or more sidewalls defining a chamber;

an anchor associated with at least one of said one or more sidewalls of said support member, said anchor positioned in spaced apart relation to an upper end of said support member;

an antenna having a lower end and an upper end; and an antenna mount mounting said antenna to said support member at or near said upper end thereof, said antenna mount having a mounting plate attached to or integral with said upper end of said antenna, a pivoting mechanism interconnecting said mounting plate and said support member and a biasing mechanism interconnecting said pivoting mechanism and said anchor, said pivoting mechanism having a pivot section attached to or integral with said mounting plate and a stationary section attached to or integral with said support member, said pivoting mechanism structured and arranged to support the antenna in a desired operating position and allow said mounting plate and said antenna to move to a pivoted position in response to an external force that is applied to said antenna, said biasing mechanism having a biasing member with a first end attached to or integral with said anchor and a second end attached to or integral with said pivot section of said pivoting mechanism, said biasing mechanism structured and arranged to hold said antenna in the desired operating position and to move said antenna from the pivoted position to the desired operating position after application of the external force.

20. The antenna assembly of claim 19, wherein the support member is associated with a vehicle so as to support said antenna mount and said antenna on the vehicle as the vehicle moves through an area having an object which applies the external force to said antenna when the object contacts said antenna.

* * * * *